US005513816A

United States Patent [19]

Grubb

[11] Patent Number: 5,513,816

[45] Date of Patent: May 7, 1996

[54] LINE FLAKING SYSTEM

[76] Inventor: Peter J. Grubb, 487 Spring St., Newport, R.I. 02840

[21] Appl. No.: 174,663

[22] Filed: Dec. 28, 1993

[51] Int. Cl.[6] ..... B65H 75/44; B63B 21/16

[52] U.S. Cl. ..... 242/398; 242/400.1; 242/129; 242/597.1; 114/254

[58] Field of Search ..... 242/400.1, 401, 242/405.1, 407, 407.1, 129, 597.5, 597.6, 400, 398, 402, 404.3, 597.1, 614; 114/254

[56] References Cited

U.S. PATENT DOCUMENTS

| | | | |
|---|---|---|---|
| 2,693,001 | 11/1954 | Vance | 15/323 |
| 3,395,308 | 7/1968 | Meyer | 242/129 |
| 4,381,087 | 4/1983 | Williams | 242/597.1 |
| 4,809,393 | 3/1989 | Goodrich et al. | 242/400.1 X |

*Primary Examiner*—John Q. Nguyen

*Attorney, Agent, or Firm*—Robert K. Tendler

[57] ABSTRACT

A dual pivoted hook line stowing or flaking system is provided for storing coiled line either vertically as on a mast or horizontally as on a deck, in which both of the hooks contain tabs rotatable in a plane parallel to the plane of the loops from outwardly pointed positions to inwardly pointed positions. The rotation of the tabs to the interior of the coiled or looped line permits easy removal of the line for rapid lowering of the sails or to permit unfettered casting or throwing of the line from a coiled position on deck. In one embodiment, the pivoted hook includes a two part structure, with a fixed flange base and an integral fixed barrel into which is inserted a rotatable barrel with the top secured to the top of the rotatable barrel. The distal end of the rotatable barrel is provided with slots and an outwardly projecting slotted flange member, whereas the interior base of the flange includes inwardly projecting detents, such that the tab is realeasably secured against rotation until turned with a quick twist.

2 Claims, 4 Drawing Sheets

LINE FLAKING SYSTEM

FIELD OF INVENTION

This invention relates to line stowing devices and more particularly to a line flaking device for quickly releasing flaked or coiled line.

BACKGROUND OF THE INVENTION

In sailing and boating there is a requirement that lines be easily coiled and stowed, while at the same time being ready for use at a moment's notice. Especially in sailing, where a main halyard is utilized to raise and lower the main sail, in emergency conditions, it is exceedingly important to be able to release the main halyard, which is usually coiled and looped over a fixed cleat on the mast. Such an arrangement oftentimes precludes quick release of the halyard as the halyard can become tangled, with the result that the halyard jams and the main sail cannot be brought down. Were the line to be quickly releasable, the prescribed operation requires simply dropping the line to the deck where it can pay up the mast as the sail comes down.

Additionally, the securing the halyard to the mast usually entails coiling the line or the halyard and then securing the loops only at the top to the fixed cleat. In heavy seas, the coiled line can flap around, with the halyard eventually becoming dislodged from its position over the fixed cleat.

Jib sheets on the other hand are often difficult to store after the jib or foresail is properly adjusted and cleated off. The storage of jib sheets is a problem due to the large amount of line which is required for the sheet. Typically these sheets are simply dropped in the cockpit or stowed in some other indiscriminate fashion. Obviously in order to be able to trim the sheets or release them, it is important that whatever storage device is provided, the line must be accessible immediately so as to be able to readjust the sheet or, in fact, cast it off.

Likewise, for anchor line, storage of the anchor line on deck is always a problem, necessitating traditional anchor lockers. It is not always convenient to provide anchor lockers for the anchor line and rope, and it is therefore important to be able to coil the anchor line on deck. Freely coiled anchor line, however, is subject to being uncoiled either by wave action, wind or seas coming over the bow. Thus it is important to be able to provide a secure means for storing anchor line, while at the same time providing that it be quickly removable in cases of emergency or in cases of the usual line handling requirements, such as for docking, or for anchoring.

In the past, opposed hook-like structures have been utilized for the coiling of cord, primarily of electric vacuum cleaner power cords in which the power cords are looped around fixed oppositely directed hooks. In an effort to provide that such electrical cords be easily releasable, systems such as illustrated in U.S. Pat. Nos. 2,003,147 and 2,693,001 utilize one fixed hook and the other hook which is slidable in a direction of the fixed hook to permit releasing of the cord. This type of release is not particularly applicable to the boating requirements due to the fact that the line or cord can be caught upon or entangled in the fixed hook.

As illustrated by U.S. Pat. Nos. 3,290,453; 2,193,989; 1,728,106; and 4,277,035, in order to release cordage or line, the prior hooklike structures are rotated into the center of the loop by pivoting the hooklike structure along a pivot which runs in the plane of the loops and transverse to the longitudinal axis of the loops. As will be seen from these patents, in order to provide such pivoting, complicated pivoting structures are often utilized such that the hooks are in essence folded down into the coiled loop structure. Other U.S. Patents relating to the coiling of electric line include U.S. Pat. Nos. 337,637; 1,365,762; 2,001,588; 2,025,437; 2,536,776; 2,747,812; 3,198,343; 3,477,585; 4,067,526; and 4,354,650.

Of particular interest is U.S. Pat. No. 4,062,430 which provides a quick release cord storage hook, which is a two-tang device such that when it is rotated about a pivot vertical to the loop axis, a second hook engages a portion of the looped cord. Thus while some of the strands or loop of the cord are released, others are not. This type of apparatus is clearly ill-advised for use aboard boats, be they sailing vessels or motor vessels, due to the clamping of part of the coiled line when the hook is in the release position.

Moreover, none of the above U.S. patents shows the utilization of two rotatable or moveable hooks for coiled line storage. This is important in the field of boating and sailing because any impediment to the release of the line can result in disastrous consequences. Thus, while quick release coiled devices have been utilized specifically for electrical appliances including vacuum cleaners, their utilization in the marine environment is not only ill-advised but hazardous to the extent that they do not permit unfettered uncoiling of the line.

SUMMARY OF THE INVENTION

In order to achieve convenient stowage or flaking of lines aboard marine vessels, two spaced apart rotatable hooks are provided onto which the line may be flaked or coiled. Note that the rotatable hooks can be spaced at customized distances depending on the length and thickness of the line to be coiled. The hooks are in two parts, with a fixed member and a rotatable member. Both fixed and rotatable members have cylindrical barrels, with the rotatable barrel carried coaxially within the fixed barrel. The rotatable barrel has an integral tab at its top to secure the line in one position and to rotate out of the way in the release position.

By merely rotating the tabs to the interior of the coil of the line, the line can slip off the fixed barrels and easily pays out for sail removal, sail trimming, line throwing or anchoring. Note that because the outer barrel is fixed, the line does not bear on a rotatable member since it is only the inner barrell which rotates. This makes turning of the retaining tabs exceptionally easy.

In a preferred embodiment, the anchoring hooks include a two-part structure in which the barrel includes a flange adapted to be secured to the boat, and with the fixed barrel extending from the flange. The hook-like tab portion includes an inner barrel which fits coaxially in the fixed barrel. The base of the rotatable barrel attached to the tab is itself flanged at its distal end, with this barrel having notches extending from the distal end towards the tab, part way up the barrel. These notches permit inward flexing of the interior barrel so that the flange position can pass through the opening of the outer barrel during assembly. The notches in the flange for the rotatable barrel coact with detents which project inwardly from the periphery of the base of the outer barrel such that when the tabs are rotated, the notched flange portions move inwardly to permit the rotation as they are camed over the inwardly projecting detents. When the tab is rotated 180°, the slotted portions of the flange rest in the detents thereby to secure the tab rotationally in position.

Thus dual pivoted hook line stowing or flaking system is provided for storing coiled line either vertically as on a mast or horizontally as on a deck, in which both of the hooks contain tabs rotatable in a plane parallel to the plane of the loops from outwardly pointed positions to inwardly pointed positions, to permit easy removal of the line for rapid lowering of the sails or to permit unfettered casting or throwing of the line from a coiled position on deck. In one embodiment, each rotatable hook is rotated about an axis perpendicular to the plane of the coiled line. Note that the line may be coiled in loops or Figure 8s, which is preferred for on deck use to prevent fouling and easy pay-out. Note further that if a rotatable hook is located near a winch, the winch can replace the second hook. As such, the Subject Invention is not limited to two rotatable hooks. Thus the hooks can be used independently if desired.

BRIEF DESCRIPTION OF THE DRAWINGS

These and other features of the Subject Invention will be better understood in conjunction with the Detailed Description taken in conjunction with the Drawings of which.

DETAILED DESCRIPTION

Figure 1A:
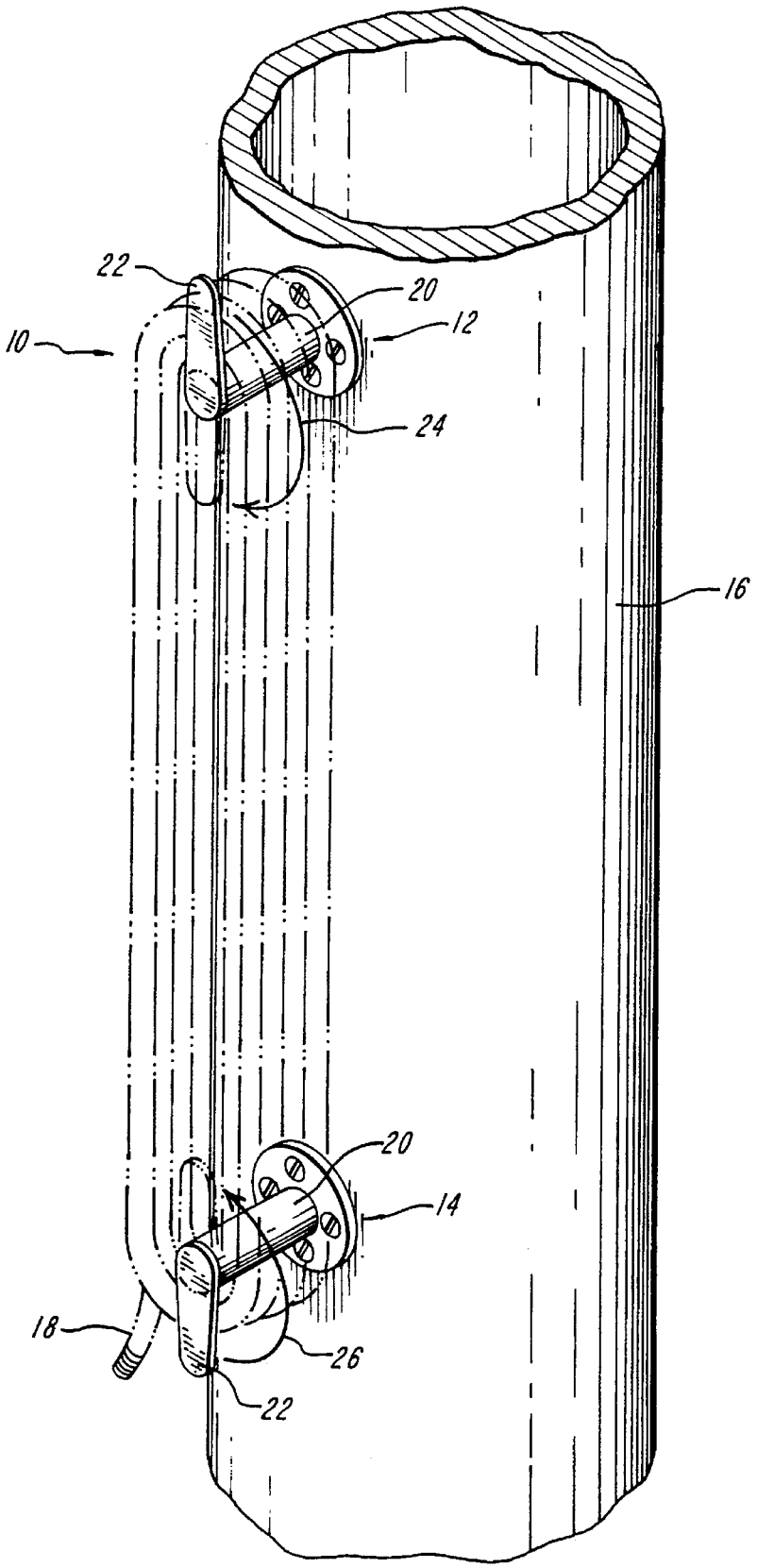
FIG. 1A is a diagrammatic representation of the utilization of the double rotating hook rope flaking system in which a halyard is illustrated as looped or coiled about spaced apart hooks, with the hooks being rotatable 180° to permit removal of the looped halyard from the barrels of the hooks.

Referring now to FIG. 1A, a flaking system 10 includes a pair of spaced apart rotatable flaking hooks 12 and 14 mounted to a mast section 16 such that a halyard 18 can be looped or flaked about the two rotatable flaking hooks as illustrated. It will be appreciated that each of the flaking hooks has a fixed barrel portion 20 and a rotatable tab portion 22. As illustrated, the tabs point away from each other, to permit retaining the coiled halyard line or cable such that the halyard line or cable does not slip off the fixed barrels.

When it is desired to remove the flaked line, tabs 22 are rotated in the direction of arrows 24 and 26 such that the tabs end up pointed at each other or facing each other within the loops of the coiled or flaked halyard. Note that in order for the tab portion of the hooks to permit removal of the flaked line, they are rotated in the plane of the loops, rather than perpendicular to this plane. This simple rotary motion of the tabs with respect to the fixed barrels provides for an exceptionally simple pivoted movement in which the tabs are moved completely out of the way of the line for its easy and unfettered removal.

Figure 1B:
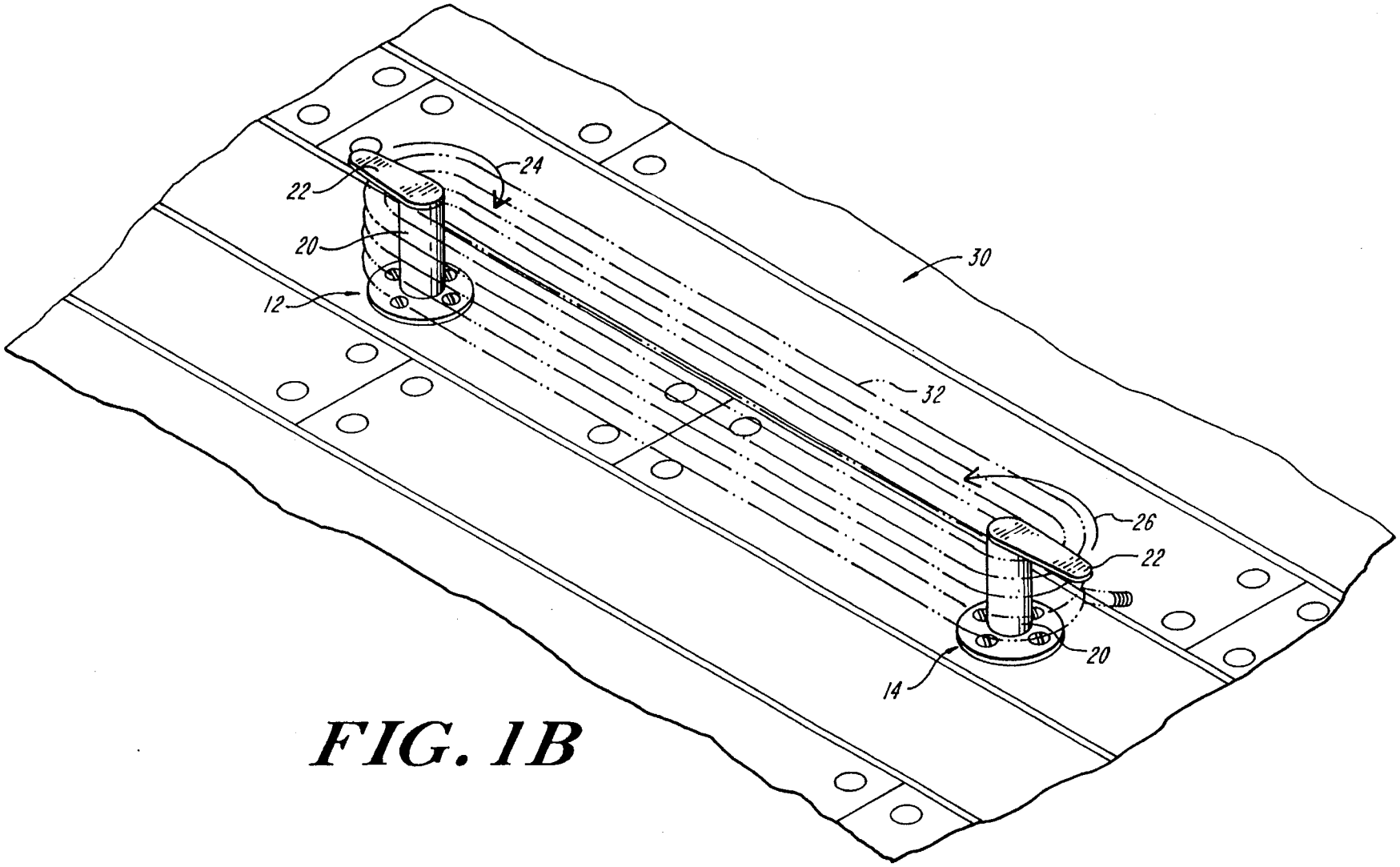
Figure 1B is the diagrammatic illustration of the utilization of the subject flaking system involving spaced apart hooks mounted to the deck of a vessel for the flaking of line therebetween, also indicating the rotation of the hooks towards the center of the loops to permit removal of the line.

A similar flaking installation is shown in FIG. 1B in which rotatable flaking hooks 12 and 14 are mounted to a deck 30 such that line 32 may be flaked on the deck and immediately released by movement of tabs 22 in the direction of arrows 24 and 26 so that these tabs face or point at each other within the looped structure to permit unfettered removal.

Figure 2:
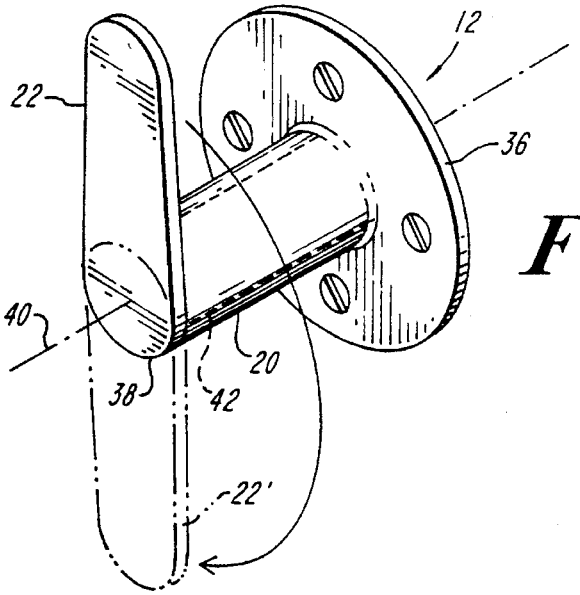
FIG. 2 is a diagrammatic illustration of one of the flaking hooks illustrating the utilization of a rotatable tab.

Referring now to FIG. 2, it can be seen that each of the flaking hooks here illustrated at 12 includes fixed barrel 20 integrally formed with a flanged base 36, with tab 22 rotatably mounted to barrel 20 such that in one embodiment the edge 38 of the tab 22 at pivot point 40 does not extend into interior channel 42. Thus when tab 22 is rotated to the position 22', edge 38 does not present a lip that the flaked line, halyard or cable can catch on.

Figure 3:
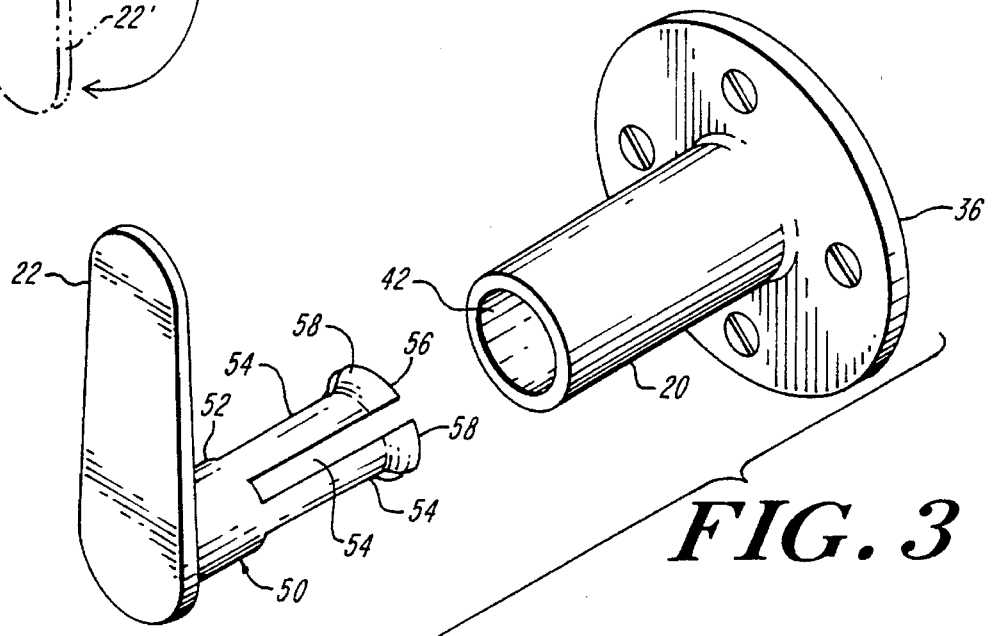
FIG. 3 is an exploded diagram of the hook of FIG. 2 illustrating a concentric barrel structure in which a slotted flange rotatable barrel integral to the tab portion is inserted into the fixed barrel.

Referring now to FIG. 3, in one embodiment, a simple two-part structure is illustrated in which fixed barrel 20 and integral flanged base 36 are adapted to be fixed to a support with barrel 20 having an interior channel 42 into which is inserted a slotted rotatable barrel 50 to which tab 22 is integrally attached. It will be appreciated that the diameter of neck 52 of barrel 50 is such that it coacts with the interior 42 of barrel 20 in a relatively tight fit. It will also be appreciated that barrel 50 is slotted as illustrated at 54 from the distal end 56 part way up towards tab 22.

Distal end 56 of rotatable barrel 50 is also provided with flange portions 58 which are separated by slots 54, adapted to coact with detents to prevent free rotation of the tab.

Figure 4:
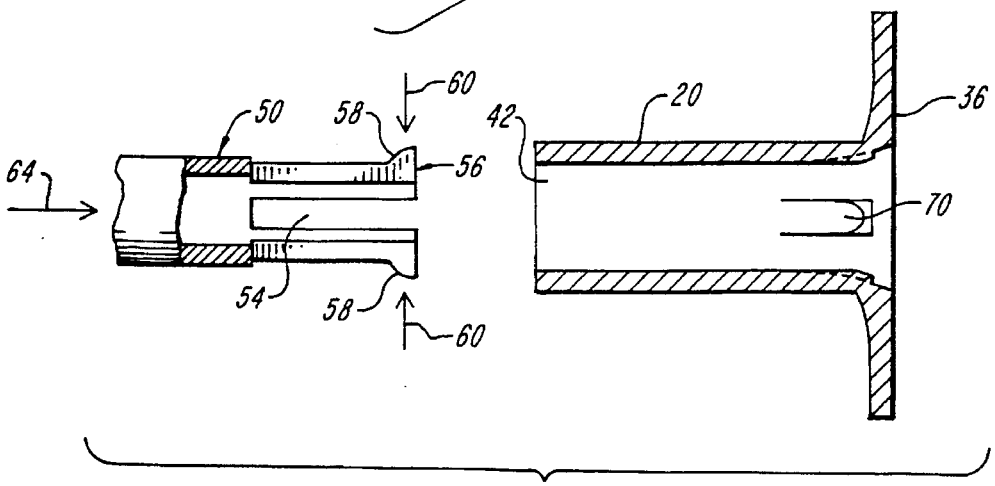
FIG. 4 is a partial sectional view of the hook structure of FIG. 3 illustrating the inward flexing of the slotted flange of the rotatable interior barrel to permit insertion of this barrel into the fixed barrel.

Referring to FIG. 4, during assembly, barrel 50 is inserted into channel 42 of barrel 20 by caming in slotted flange portions 58 as illustrated by arrows 60 such that distal end 56 fits within channel 42 when barrel 50 is moved towards the barrel 20 as illustrated by arrow 64. It will be noted that integral to fixed barrel 20 are inwardly disposed detents 70 located at or adjacent flange 36 to coact with slots 54 for preventing easy rotation of the rotatable barrel within the fixed barrel.

Figure 5A:
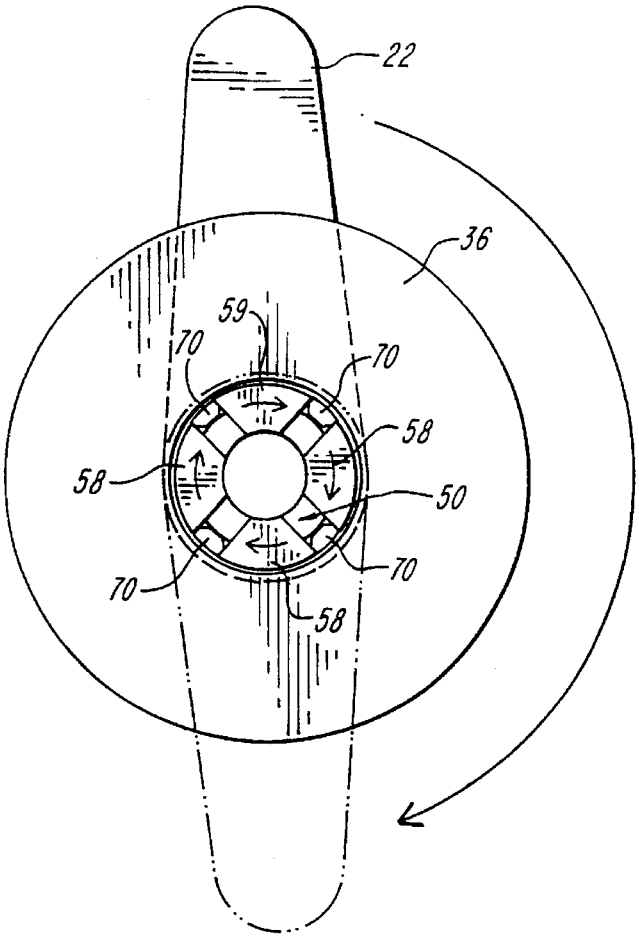
FIG. 5A is a bottom view of the hook of FIG. 3, illustrating that upon rotation of the tab the flange at the distal end of the rotatable barrel moves in a like direction such that the flange is camed inwardly by the detents integral to the interior of the fixed flange; and, FIG. 5B is a diagrammatic illustration of the inward motion of the slotted flange upon caming action provided by the detents in the fixed flange, thus to permit rotation of the tab.

Referring now to FIG. 5A, rotation of tab 22 is accomplished by virtue of the movement of tab 22 relative to base 36 such that slotted flange portions 58 rotate with the rotation of tab 22. Here it will be seen that detents 70 initially prevent the barrel 50 from rotating. Upon caming of the slotted flange portions 58 inwardly as illustrated by arrows 74 in FIG. 5B, as the slotted flange portions pass over detents 70, this flexure of the rotatable inner barrel frees tab 22 so that it can move until such time as a slot 54 moves into position over a corresponding detent.

While in the illustrated embodiment, two orthogonal slots producing four slotted flange portions are shown, it will be appreciated that any number of slotted flange portions can be utilized in the Subject Invention. For instance, it is possible to have only two slotted flange portions with a transverse slot through the rotatable barrel, although this type of configuration is difficult to assemble and is not as easily rotated due to the limited caming action available.

Figure 5B:
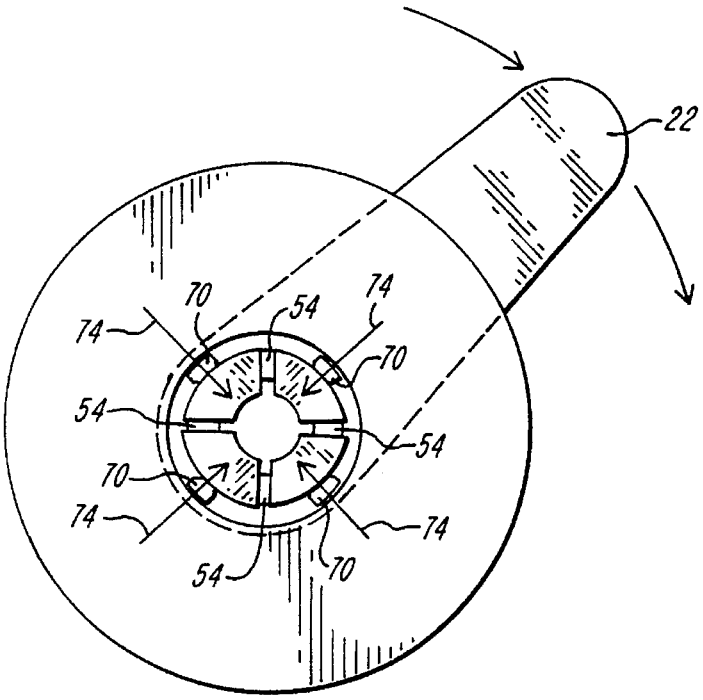

It will also be appreciated with orthogonally oriented transverse slots as illustrated in FIGS. 5A and 5B, tab 22 will reach a detent stop position 90° from its original position. Because of the ease with which the flanged distal end of the rotatable barrel is flexed by the detents, it is not a problem to move past this 90° position to a 180° position for releasing the flaked line, halyard or cable.

What has therefore been provided is an exceptionally simple two rotatable hook system for coiled lines, ropes, halyards, cables and the like. It is characterized in that the flaking hook includes a tab which is rotated in a plane parallel to the plane of the coiled ropes or lines on an axis perpendicular to the plane of the coils. This permits rotating the tab within the loop structure, such that the coiled line may be easily removed without snagging or binding. The easy removal of line has particular import in the marine industry in which violent weather conditions require that line be stowed properly and be quickly releasable without snagging or fouling. The subject flaking system provides reliability and simplicity which contributes to the safety of boating and sailing.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. Apparatus for easy release flaking of a line to store said line in a coiled condition at a predetermined location on a boat and to free said line for immediate use comprising:

a pair of rotatable hooks each adapted to be fixedly attached to said boat, each of said hooks having a fixed barrel about which said line is to be flaked in loops in direct contact with said barrel, said fixed barrel having a longitudinal axis, each of said hooks having a tab; and, means for rotatably mounting said tab at the distal end of said fixed barrel such that said tab extends laterally from the longitudinal axis of said fixed barrel, said tab being rotatable about an axis parallel to the longitudinal axis of said fixed barrel such that when said tab is rotated away from between the loops, it serves to retain said line in place on said fixed barrel, and such that when said tab is rotated to a position between said loops, said line is easily removed therefrom, said fixed barrel having a longitudinal cavity therein, said means for rotatably mounting said tab including an inner barrel of material adapted to be inwardly flexed to enable carriage thereof in said cavity, said inner barrel being rotatable with said tab, said inner barrel having a distal end and including a number of longitudinally running slots extending from said distal end thereby to form barrel members to either side of said slots, said fixed barrel including radially inwardly projecting detents adapted to be positioned within said slots to releasably limit the rotational movement of said tab.

2. The apparatus of claim 1, wherein the distal end of said inner barrel includes a radially outwardly projecting flange having slots therein, said slotted inner barrel with flange being radially inwardly flexible to permit insertion of said inner barrel into said fixed barrel by radially inwardly flexing said barrel members, with the slots in said flange corresponding in position to the position of the slots in said inner barrel.

* * * * *